United States Patent [19]

Gfrerer

[11] Patent Number: 4,557,805

[45] Date of Patent: Dec. 10, 1985

[54] ASSEMBLY FOR CONTROLLING THE POSITIONING OF COKE OVEN OPERATING MACHINES

[75] Inventor: Manfred Gfrerer, Erlangen, Fed. Rep. of Germany

[73] Assignee: Siemens Aktiengesellschaft, Berlin and Munich, Fed. Rep. of Germany

[21] Appl. No.: 695,070

[22] Filed: Jan. 25, 1985

[30] Foreign Application Priority Data

Jan. 26, 1984 [DE] Fed. Rep. of Germany ..... 3402690

[51] Int. Cl.[4] ..... C10B 45/00

[52] U.S. Cl. ..... 202/270; 201/1; 201/41; 202/262

[58] Field of Search ..... 201/1, 41; 202/262, 202/270; 414/215, 396, 401; 364/183, 174, 167; 250/223 R

[56] References Cited

FOREIGN PATENT DOCUMENTS

| | | | |
|---|---|---|---|
| 2203524 | 8/1973 | Fed. Rep. of Germany | 202/270 |
| 2648049 | 4/1978 | Fed. Rep. of Germany . | |
| 58-180582 | 10/1983 | Japan | 202/262 |
| 59-049286 | 3/1984 | Japan | 202/262 |
| 7009105 | 12/1970 | Netherlands | 202/262 |
| 889682 | 3/1980 | U.S.S.R. | 201/1 |
| 883147 | 11/1981 | U.S.S.R. | 202/270 |
| 912747 | 3/1982 | U.S.S.R. | 202/270 |

*Primary Examiner*—Peter Kratz
*Assistant Examiner*—M. McGurk
*Attorney, Agent, or Firm*—Kenyon & Kenyon

[57] ABSTRACT

At a coke oven of a coking plant, each operating machine is provided with a U-shaped detector unit equipped with infrared light gates. Each operating station of the coke oven is provided with a signal plate carrying positioning marker elements for fine tuning the positioning of the operating machine at the operating station and with identification marker elements for identifying the respective operating stations. Each infrared light gate includes an infrared light source and an infrared light sensor connected to an electronic evaluation circuit comprising a memory with a reading monitor for detecting and correlating the coded identification markers on the signal plates. The electronic evaluation circuit also includes an electronic position evaluation subcircuit which controls the drive of the respective coke oven operating machine to move the same at a reduced speed if a first positioning pulse is transmitted and to stop the operating machine upon the occurrence of a pair of positioning pulses as well as an identification signal identifying a desired operating station.

12 Claims, 4 Drawing Figures

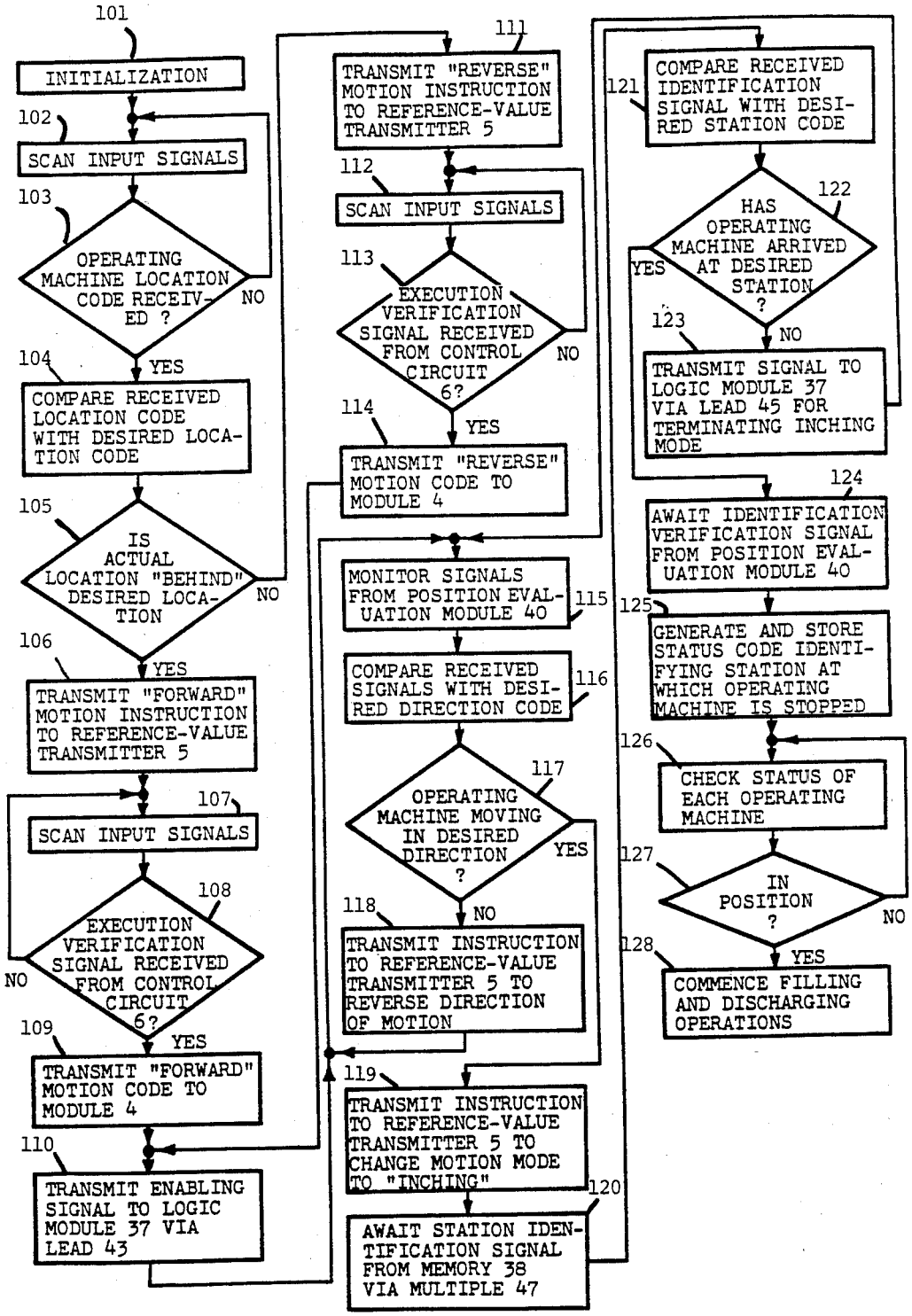
101
INITIALIZATION
102
SCAN INPUT SIGNALS
103
OPERATING MACHINE LOCATION CODE RECEIVED ?
NO
YES
104
COMPARE RECEIVED LOCATION CODE WITH DESIRED LOCATION CODE
105
IS ACTUAL LOCATION "BEHIND" DESIRED LOCATION
NO
YES
106
TRANSMIT "FORWARD" MOTION INSTRUCTION TO REFERENCE-VALUE TRANSMITTER 5
107
SCAN INPUT SIGNALS
108
EXECUTION VERIFICATION SIGNAL RECEIVED FROM CONTROL CIRCUIT 6?
NO
YES
109
TRANSMIT "FORWARD" MOTION CODE TO MODULE 4
110
TRANSMIT ENABLING SIGNAL TO LOGIC MODULE 37 VIA LEAD 43
111
TRANSMIT "REVERSE" MOTION INSTRUCTION TO REFERENCE-VALUE TRANSMITTER 5
112
SCAN INPUT SIGNALS
113
EXECUTION VERIFICATION SIGNAL RECEIVED FROM CONTROL CIRCUIT 6?
NO
YES
114
TRANSMIT "REVERSE" MOTION CODE TO MODULE 4
MONITOR SIGNALS FROM POSITION EVALUATION MODULE 40
115
COMPARE RECEIVED SIGNALS WITH DESIRED DIRECTION CODE
116
117
OPERATING MACHINE MOVING IN DESIRED DIRECTION ?
YES
NO
118
TRANSMIT INSTRUCTION TO REFERENCE-VALUE TRANSMITTER 5 TO REVERSE DIRECTION OF MOTION
119
TRANSMIT INSTRUCTION TO REFERENCE-VALUE TRANSMITTER 5 TO CHANGE MOTION MODE TO "INCHING"
120
AWAIT STATION IDENTIFICATION SIGNAL FROM MEMORY 38 VIA MULTIPLE 47
121
COMPARE RECEIVED IDENTIFICATION SIGNAL WITH DESIRED STATION CODE
122
HAS OPERATING MACHINE ARRIVED AT DESIRED STATION ?
YES
NO
123
TRANSMIT SIGNAL TO LOGIC MODULE 37 VIA LEAD 45 FOR TERMINATING INCHING MODE
124
AWAIT IDENTIFICATION VERIFICATION SIGNAL FROM POSITION EVALUATION MODULE 40
125
GENERATE AND STORE STATUS CODE IDENTIFYING STATION AT WHICH OPERATING MACHINE IS STOPPED
126
CHECK STATUS OF EACH OPERATING MACHINE
127
IN POSITION ?
NO
YES
128
COMMENCE FILLING AND DISCHARGING OPERATIONS

ASSEMBLY FOR CONTROLLING THE POSITIONING OF COKE OVEN OPERATING MACHINES

BACKGROUND OF THE INVENTION

This invention relates to an operating machine shiftably mounted on a track alongside a coke oven at a coking plant. More particularly, this invention relates to an assembly at the coke oven for controlling the positioning of the operating machine along the track.

A coking plant customarily includes a coke oven divided into several chambers disposed seriatim. Each chamber is provided on its sides and at the top with openings closable by respective chamber doors. Operating machines are shiftably mounted on tracks which run along both lateral sides and along the top side of the coke oven, the operating machines being designed to charge and discharge the oven chambers after the respective chamber doors are opened. At the end of the coking process, the oven chambers are discharged by pushing the glowing coke out from the chambers onto a quenching carriage. In order to ensure smooth operation of the coking plant, it is necessary to position the operating machines precisely at predetermined operating stations beside the chamber doors of the coke oven and, in addition, to position the operating machines at the correct time.

German Laid-Open Application (Deutsche Offenlegungsschrift) No. 26 48 049 discloses a method for controlling and monitoring the operation of coke oven operating machines, in which method a travel distance determination is made and which method attempts to attain fine tuning and synchronization in the positioning of the operating machines alongside the coke oven. Code plates are disposed at the operating stations of the individual coke oven operating machines, while reading devices are attached to the operating machines for detecting information coded in the code plates. The code plates simultaneously serve to mark the centers of the respective oven chambers and to fine-tune the positioning of the operating machines at the operating stations. By comparing the actual positions of the operating machines, as sensed by the reading devices in cooperation with the code plates, with the desired destinations in accordance with a current stage of a coke oven operating sequence, a central control unit generates signals for controlling the propulsion drives of the operating machines so that the machines are stopped at precise positions at the operating stations. The centers of the individual oven chambers are marked by magnets disposed on the code plates, the locations of the magnets being detected by corresponding magnetic sensors on the operating machines. The reading devices generate travel-direction reference values in the form of positive or negative voltages in accordance with the distances of the operating machines from respective operating station centers and the directions of motions of the operating machines with respect to respective operating stations.

A positioning method utilizing magnetic sensor and magnetic position markers is disadvantageous owing to an inherently low positioning accuracy resulting from the relative flatness, in the vicinity of a zero point, of the graph of the magnetic field strength as a function of the direction of motion, the control voltages generated by Hall effect generators being concomitantly flattened.

An object of the present invention is to provide an improved assembly for controlling the positioning of coke oven operating machines along respective tracks.

A more particular object of the present invention is to provide such an assembly in which the positioning of the operating machines alongside a coke oven is accurate to millimeters.

Another particular object of the present invention is to provide such as assembly which is relatively insensitive to dust and heat.

SUMMARY OF THE INVENTION

An assembly for controlling the positioning of an operating machine along a track at a coke oven comprises, in accordance with the present invention, at least one signal plate, a detector cooperating with the plate, a drive coupled to the operating machine for shifting the machine along the track, and a control unit operatively connected to the detector and to the drive for controlling the motion and positioning of the operating machine along the track in response to positioning signals and identification signals received from the detector during a shifting of the operating machine along the track. The detector includes a plurality of signal transmitters in the form of infrared light sources and a like plurality of signal receivers in the form of infrared light sensors. The transmitters and receivers cooperate with the signal plate to generate the positioning signals indicating the arrival of the operating machine at an operating station and the identification signals indicating the location of the operating station (i.e., the identity thereof) with respect to the coke oven. The detector further includes a U-shaped carrier having a pair of opposed legs accommodating the transmitters and receivers. One of the carrier and the signal plate is mounted to the operating machine, while the other is stationary with respect to the coke oven so that the legs of the carrier are disposed on opposite sides of the signal plate upon arrival of the operating machine at the operating station. The control unit includes an electronic evaluation circuit and operates, during a shifting of the operating machine along the track, to reduce the velocity of the operating machine upon the transmission of a first positioning signal from the detector to the control unit. The control unit stops the translation of the operating machine along the track upon the transmission of a second positioning signal and of an identification signal coding a preselected location alongside the coke oven. Alternatively, if the identification signal codes an unselected location alongside the coke oven, the control unit induces an increase in the speed of the operating machine.

The signal plate advantageously includes a support body and at least two positioning marker elements (such as small plates) and a plurality of identification marker elements all mounted to the support body. The positioning marker elements are spaced from one another along a first line substantially parallel to the track, while the identification marker elements are aligned along a second line spaced from and substantially parallel to the first line. The marker elements are opaque to a wavelength of infrared light generated by the transmitters and detected by the sensors.

The transmitters, together with respective receivers, form a multiplicity of light gates, two of the light gates being disposed in a first plane containing the first line and a plurality of the light gates being disposed in a second plane containing the second line and oriented parallel to the first plane. The first positioning signal is generated by the detector in response to an interruption of an infrared light beam of one light gate in the first plane by one of the positioning marker elements. The second positioning signal is generated in response to an interruption of infrared beams of two light gates in the first plane by the positioning marker elements. The identification signal is produced by light gates in the second plane upon generation of the second positioning signal and in accordance with interruptions of infrared light beams of light gates in the second plane by the identification marker elements.

The electronic evaluation circuit preferably includes an addressable or read memory and a read-monitoring subcircuit which cooperate with one another for detecting and correlating the coded identification marker elements on the signal plate with the light gates of the detector to identify the location of an operating station occupied by the operating machine at the time an identification signal is generated.

The electronic evaluation circuit further includes an electronic position evaluation subcircuit operatively connected to the memory and the read-monitoring subcircuit and to the drive for controlling the speed and direction of motion of the operating machine along the track.

In accordance with another feature of the present invention, the signal plate is vertically oriented and the second line, defined by the identification marker elements, is located above the first line, defined by the positioning marker elements. The positioning marker elements are preferably attached to the support body at opposite ends thereof, while the identification marker elements are advantageously attached to the support body along an upper edge thereof so that the identification marker elements extend beyond that upper edge.

Pursuant to another feature of the present invention, at least one of the positioning marker elements is adjustably attached to the support body for altering the spacing of the positioning marker elements along the first line.

Pursuant to yet another feature of the present invention, the electronic read-monitoring circuit is operatively connected to the detector for continuously monitoring electrical output signals of the light gates during travel of the operating machine along the track between adjacent operating stations.

An assembly for positioning an operating machine at a coke oven, in accordance with the present invention, is simple and compact. The simplicity and compactness of the assembly arises in part from the utilization of identical components for identifying the stopping point and for exactly positioning the operating machine at an operating station. The use of infrared radiation as the information carrier eliminates the detrimental effects of dust and heat on the accuracy of the positioning system. Because the infrared light may be focussed by optical components such as lenses and because light gates may be used, high response accuracy and high response speed may be achieved. The use of infrared transmitters and receivers permits, inter alia, the identification of location without the interruption of the operating machine motion.

The disposition of positioning marker elements along one line at opposite ends of a support body and the disposition of identification marker elements along a top edge of the support body provides a very compact arrangement of the positioning and identification marker on a single plate, while permitting the detection of travel direction, position identification and fine tuning of the positioning process.

BRIEF DESCRIPTION OF THE DRAWING

FIG. 4 is a flow chart diagram showing a sequence of operating steps performed by the computer of FIG. 1 in controlling a positioning assembly in accordance with the present invention.

DETAILED DESCRIPTION

Figure 1:
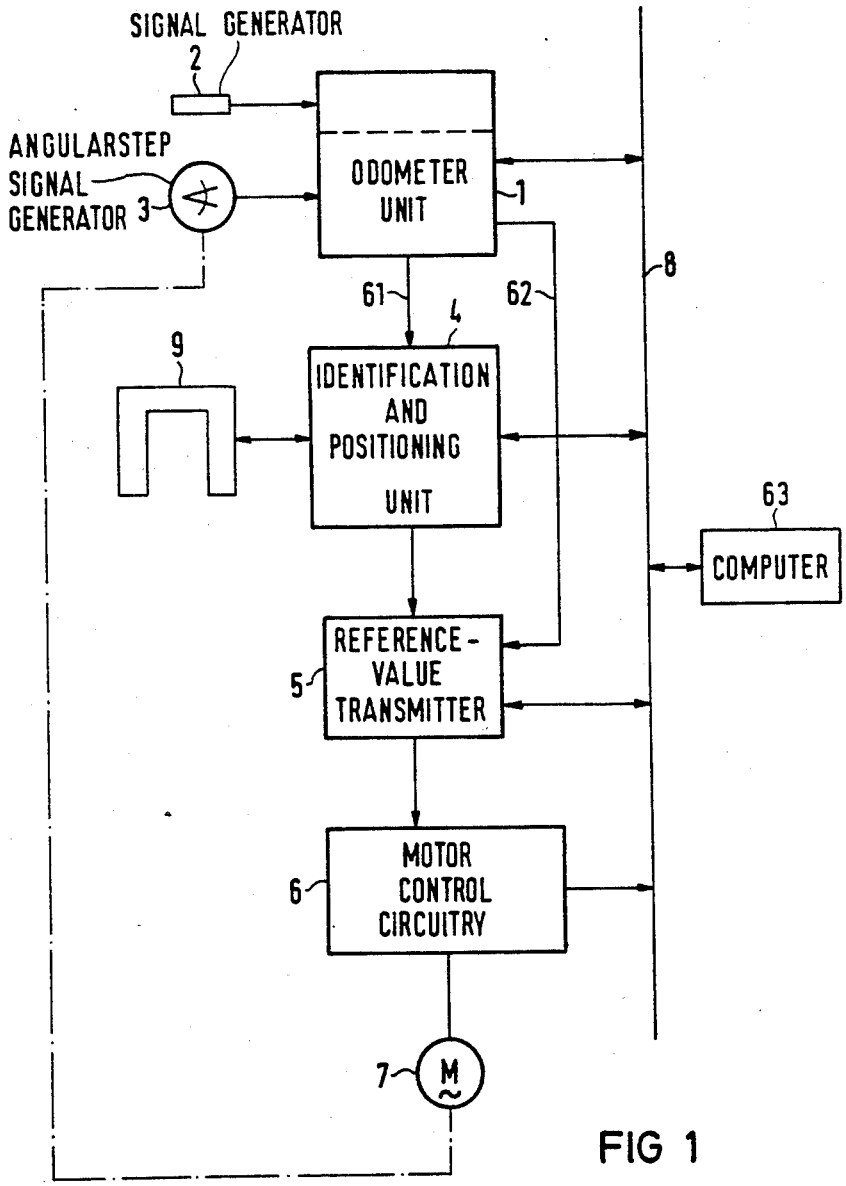
FIG. 1 is a block diagram of an assembly in accordance with the present invention for controlling the positioning of a coke oven operating machine, showing a U-shaped detector device, an identification and positioning unit and a computer.

As illustrated in FIG. 1, an assembly for controlling the positioning of an operating machine alongside a coke oven of a coking plant comprises an odometer unit 1 for determining the distance traveled by the operating machine. Odometer unit 1 is connected at an input to a signal generator 2 exemplarily in the form of a magnetic pickup juxtaposed to a wheel of the operating machine. An angular-step signal generator 3 coupled to a drive motor of the coke oven operating machine is connected to another input of odometer unit 1.

Odometer unit 1 is connected via a pair of output leads 61 and 62 to an identification and positioning unit 4 and a reference-value transmitter 5, respectively, for transmitting thereto a location signal formed in response to signals produced by signal generators 2 and 3. Reference-value transmitter 5 is connected to a motor control circuit 6 in turn electrically coupled with drive motor 7 for controlling the operation thereof.

Identification and positioning unit 4 is connected to a detector device 9 which is preferably mounted on the operating machine and which generates, in cooperation with signal plates fastened to the coke oven, positioning and indentification signals as described hereinafter. The identification and positioning unit is also connected at an output to reference-value transmitter 5. Odometer unit 1, identification and positioning unit 4, reference-value transmitter 5 and motor control circuit 6 are all connected to a control computer 63 via a data bus 8.

In accordance with the signals received from generators 2 and 3, odometer unit 1 transmits a location signal to computer 63 via bus 8. Computer 63, having commenced operations in an initialization step 101 (see FIG. 4) awaits the receipt of the location signal from odometer unit 1. Computer 63 scans input signals in a step 102, continuously inquiring at a decision junction 103 whether an operating machine location code has been received from odometer unit 1. Upon the receipt of the location code, computer 63 compares, in a step 104, the received location code with a desired location value. If the actual location is to one side, e.g., behind or to the left, of the desired location, as discovered by the computer at a decision junction 105, the computer 63 transmits, in a step 106 a "forward" motion instruction to reference-value transmitter 5, this motion instruction corresponding to the desired direction of motion of the coke oven operating machine.

In response to the motion instruction from computer 63, reference-value transmitter 5 sends to the control circuit 6 a command to switch on and rotate the rotor of motor 7 in a direction determined by the "forward" motion instruction. Upon the execution of the command from reference-value transmitter 5 by control circuit 6, the control circuit transmits, to computer 63 via data bus 8, a verification signal indicating that the execution of the command from reference-value transmitter 5 has taken place.

As illustrated in FIG. 4, computer 63 undertakes a scan 107 of input signals from the positioning assembly. Computer 63 inquires at a decision junction 108 whether a verfication signal has been received from control circuit 6. Upon reception of the verification signal from control circuit 6, computer 63 transmits a "forward" motion code to module 4 in a transmission step 109.

In addition to the "forward" motion code from computer 63, identification and positioning module 4 receives an enabling command from odometer unit 1.

Figure 2:
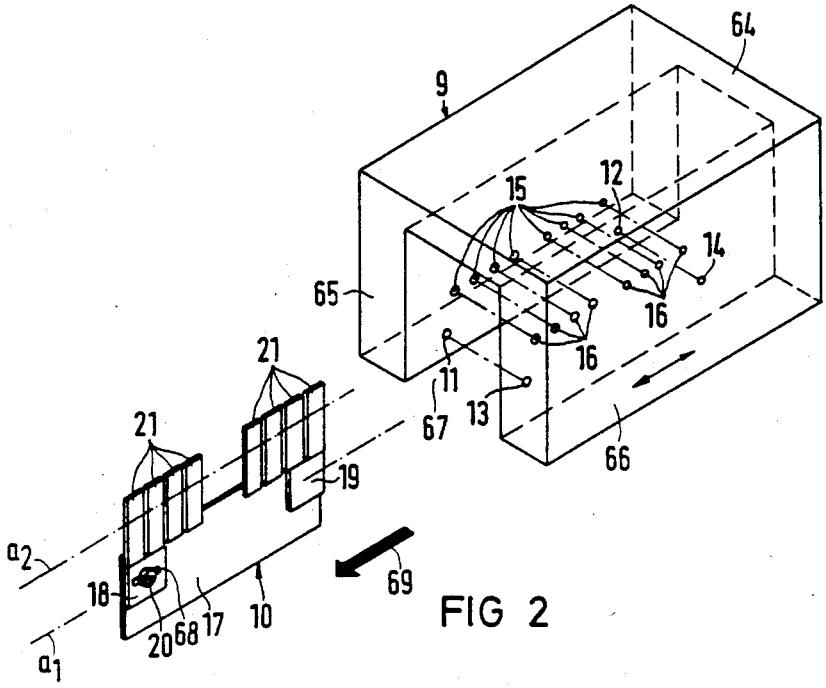
FIG. 2 is a partially diagrammatic perspective view of the U-shaped detector of FIG. 1 and a signal plate insertable between the legs of the detector.

As illustrated in FIG. 2, detector 9 includes a U-shaped carrier member 64 having a pair of parallel legs 65 and 66 defining a rectangular channel 67 therebetween. In leg 65 carrier 64 is provided with a multiplicity of transmitters 11, 12 and 15 in the form of infrared light sources. In the other leg 66 carrier 64 is provided with a like multiplicity of receivers 13, 14 and 16 in the form of infrared light sensors. U-shaped carrier 64 is advantageously attached to a coke oven operating machine so that channel 67 of the carrier faces downwardly and so that infrared light transmitters 11 and 12 and infrared light sensors 13 and 14 are disposed in a common horizontal plane, while transmitters 15 and sensors 16 are disposed in another horizontal plane spaced from and located above the plane defined by transmltters 11 and 12 and sensors 13 and 14.

Transmitters 11 and 12 are each associated with a respective one of the sensors 13 and 14 to form therewith a pair of positioning light gates. Similarly, each transmitter 15 is paired with a respective sensor 16 to from a multiplicity of identification light gates.

Each operating station of a coke oven is provided, in accordance with the present invention, with a stationary signal plate 10 exemplarily illustrated in FIG. 2. Signal plate 10 includes a support body 17 in the form of a rectangular plate, a pair of positioning marker elements 18 and 19 in form of two small square plates, and a multiplicity of identification marker elements 21 in the form of small rectangular plates. Positioning markers 18 and 19 are fastened to support body 17 at opposite ends thereof and along a line $a_1$ extending parallel to the track along which a coke oven operating machine is shiftable. Positioning markers 18 and 19 are disposed at essentially the same vertical position as the plane defined by transmitters 11 and 12 and sensors 13 and 14 (i.e., line $a_1$ is located in that plane). Similarly, identification markers 21 are attached to the top edge of support body 17 along a line $a_2$ located at substantially the same vertical position as transmitters 15 and sensors 16.

It is to be noted that both the number and the arrangement of identification markers elements 21 along the top edge of support body 17 may be varied to form a unique identification code for an operating station. The signal plate illustrated in FIG. 2 has four identification markers at one end and four identification markers at an opposite end of support body 17 with a space separating the two groups of four markers, the space being sufficient to accommodate two further markers. Another signal plate (not illustrated) might have three identification markers followed by a space in turn followed by another three identification markers followed by another space and a final identification markers. As described in detail hereinafter, detector 9 together with identification and transmitting unit 7 (see FIGS. 1 and 3) and computer 63 co-function to determine the pattern or configuration of the identification markers 21 and thereby the identity of the associated operating station.

The light gates formed by transmitters 11 and 12 and sensors 13 and 14 serve to enable the accurate positioning of an operating machine at an oven chamber (i.e., an operating station). Positioning marker elements 18 and 19 preferably extend laterally somewhat beyond support body 17 of marking plate 10 and, being arranged in the same horizontal plane as transmitters 11 and sensors 13, at least partially interrupt, in the stopped position of the associated coke oven operating machine, the infrared light beams projected from transmitters 11 and 12 towards sensors 13 and 14. At least one of positioning marker elements 18 and 19, for example, marker 18, is adjustably fastened to support body 17 by means of a screw 20, for this purpose positioning marker 18 being provided with an elongated aperture 68 extending parallel to lines $a_1$ and $a_2$. Screw 20 and aperture 68 enable an alteration of the spacing between positioning marker elements 18 and 19 so that it is equal to the spacing between the positioning light gates formed by transmitters 11 and 12 and receivers 13 and 14.

Identification marker elements 21 extend upwardly beyond the upper edge of support body 17 and, being disposed substantially in the same horizontal plane as transmitters 15 and sensors 16, completely interrupt the infrared beams of respective light gates in that plane upon a positioning of the operating machine at an operating station such that legs 65 and 66 of carrier 64 flank the signal plate 10 associated with that operating station. It is to be noted that marker elements 18, 19 and 21 are necessarily opaque to infrared radiation.

Figure 3:
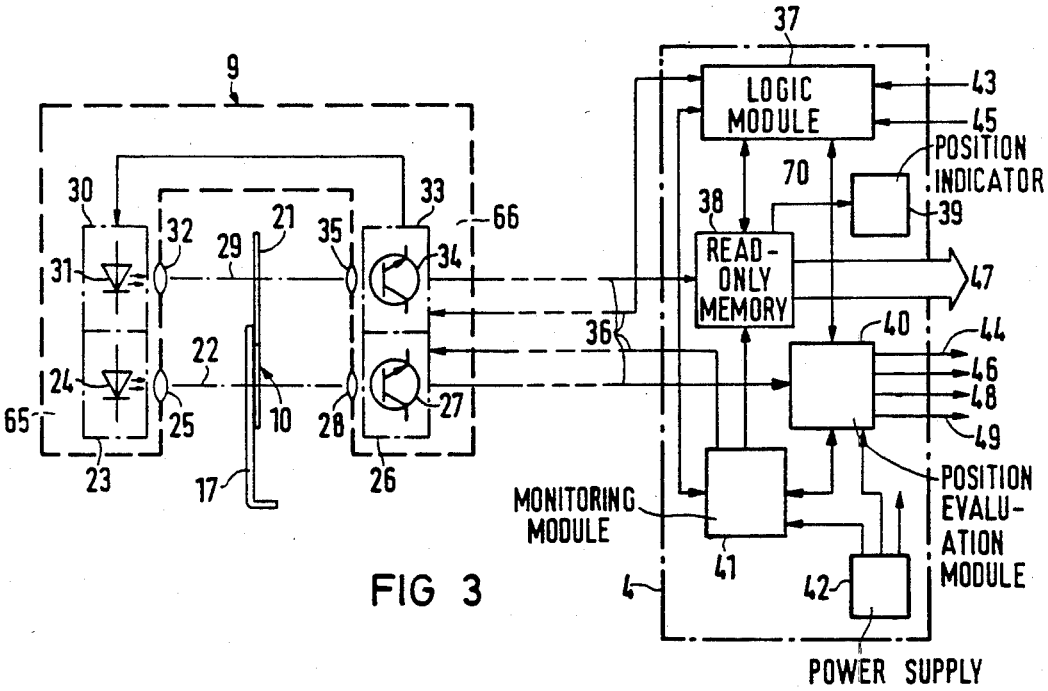
FIG. 3 is a block diagram of the identification and positioning unit and the U-shape detector of FIG. 1.

FIG. 3 diagrammatically illustrates the electrical connections between the transmitters and sensors of detector 9 and components of identification and positioning unit 4. Each transmitter and each receiver is linked to unit 4. Together with computer 63, identification and positioning unit 4 serves to evaluate identification and positioning signals transmitted by receivers 13, 14 and 16 of detector 9.

As illustrated in FIG. 3, detector 9 includes a lower infrared light gate 22 and an upper infrared light gate 29. Light gate 22 includes a transmitter or infrared light source 23, a first optical lens 25, a second optical lens 28, and a receiver or infrared light sensor 26. Transmitter 23 advantageously includes a light emitting diode 24, while sensor 26 includes a photocell 27 sensitive to infrared radiation. Similarly, light gate 29 comprises a transmitter or infrared light source 30, a pair of optical lenses 32 and 35, and a receiver or infrared light sensor 33, transmitter 30 including an infrared light emitting diode 31 and sensor 33 including an infrared-sensitive photocell 34. Transmitters 23 and 30 and receivers 26 and 33 of light gates 22 and 29 are connected to identification and positioning module 4 via a cable 36. Transmitter 23 represents either transmitter 11 or 12, while receiver 26 represents sensor 13 or 14. Analogously, transmitter 30 and receiver 33 are equivalent to any one of transmitters 15 and sensors 16, respectively.

As shown in FIG. 3, identification and positioning unit 4 includes a logic module 37, a read or addressable memory 38 (preferably a read-only memory), a position indicator 39, a position evaluation module 40, a read-monitoring module 41, and a power supply 42.

Upon the transmission of a "forward" motion code to identification and positioning module 4 by computer 63 in step 109 (FIG. 4), computer 63 transmits, in a step 110, an enabling signal to logic module 37 via a lead 43 (see FIG. 3). If computer 63 determines at decision junction 105 that the actual location of an operating machine is not "behind" a desired location, computer 63 transmits a "reverse" motion instruction to reference-value transmitter 5 in a step 111. Computer 63 thereupon awaits the transmission from control circuit 6 of a verification signal indicating that motion of the operating machine in the "reverse" direction has been induced. The computer scans input signals in a step 112 and inquires at a decision junction 113 whether the verification signal has arrived. Upon reception of the verification signal, computer 63 transmits a "reverse" motion code to identification and positioning module 4 in a step 114 and then transmits an enabling signal to logic module 37 via lead 43 (step 110).

In response to the enabling signal from computer 63, logic module 37 activates the positioning transmitters 11 and 12 (24 in FIG. 3) and the corresponding receivers 13 and 14 (26 in FIG. 3) so that the diodes of the transmitters emit infrared light converted by the associated optical lenses 25 into parallel light beams which traverse channel 67 and are focussed by the optical lenses 28 onto the receiver diodes 27 of the respective light gates.

In accordance with the motion instruction transmitted to reference-value transmitter 5 by computer 63, control circuit 6 moves the coke oven operating machine in a direction 69 (see FIG. 2) towards an operating station.

The light gate formed by transmitter 11 and sensor 13 first reaches positioning marker element 19 which cuts off a cross-section of the infrared light beam, beginning at zero and proceeding through a maximum value in the center of the light gate up to complete interruption. Sensor 13 transmits a signal to position evaluation module 40 (FIG. 3) which feeds a start pulse to computer 63 via a lead 44. The start pulse is also transmitted to logic module 37 via a bidirectional multiple 70. Identification and positioning module 4 then tests whether the direction of motion of the operating machine corresponds to the desired direction, as communicated to module 4 by computer 63 in step 109 or 114. Computer 63, also monitoring signals from position evaluation module 40 in a step 115, compares the received signals with the desired direction code in a step 116. If computer 63 discovers at a decision junction 117 that the operating machine is not moving in the desired direction, the computer transmits in a step 118 instructions to reference-value transmitter 5 to stop drive 7 of the operating machine and to reverse the direction of rotor rotation of the drive for restarting operating machine in the opposite direction. Upon finding at decision junction 117 that the actual direction of motion of the coke oven operating machine coincides with the desired direction, and upon the reception from position evaluation module 40 via an output lead 46 of a "prepositioning pulse", computer 63 transmits in a step 119 an instruction to reference-value transmitter 5 to change the motion of the coke oven operating machine to an "inching" mode, i.e., to reduce the velocity of the machine.

With respect to the configuration illustrated in FIG. 2, the coke oven operating machine with detector 9 attached thereto moves in the direction of arrow 69 at a reduced velocity during traversal of a travel distance given by odometer unit 1 of the operating machine. Upon the interruption by positioning marker elements 18 and 19 of the light gates defined by transmitters 11 and 12 and sensors 13 and 14, these sensors transmit pulses to position evaluation module 40 (FIG. 3). Position evaluation module 40 in turn informs logic module 37 of the pulses from sensors 13 and 14, whereupon logic module 37 activates memory 38 for addressing by signals from identification sensors 16.

It is to be noted that the second positioning signal, indicating the alignment of the identification light gates with the indentification marked elements, may consist of a single pulse from sensor 14 rather than concurrent pulses from both sensors 13 and 14.

Computer 63 awaits in a step 120 a station identification signal from memory 38 in response to the activation states of sensors 16. It is to be understood that if the operating machine had not been moving in the desired direction, as indicated to identification and positioning module 4 by computer 63 in step 109 or 114, computer 63 would have transmitted instructions to reference-value transmitter 5 in step 118 to reverse the direction of motion of the coke oven operating machine.

Upon the activation or enabling of memory 38 by logic module 37, output leads of identification sensors 16 simultaneously address the memory and cause the reading out therefrom onto multiple 47 of a code identifying the particular operating station associated with the signal plate 10. If the code read out from memory 38 does not coincide with the desired station code, as determined by computer 63 in a step 121 and an inquiry 123, computer 63 transmits a signal, in a step 123, to logic module 37 via lead 45 for terminating the inching mode of the operating machine. In response to that signal, logic module 37 resets position evaluation module 40, whereby the speed of the operating machine is increased to its normal level for traversing the distance between the operating station and another station adjacent thereto.

If the code read out from memory 38 coincides with the desired station code, as determined by computer 63 in step 121 and inquiry 122, computer 63 awaits in a step 124 an identification verfication signal from position evaluation module 40. Module 40 transmits this verification or "in position" signal to computer 63 via a lead 48.

Upon the arrival of the two positioning light gates of detector 9 at positioning marker elements 18 and 19, position-evaluation module 40 feeds a stop signal to control reference-value transmitter 5 which in response de-energizes drive motor 7 of the coke oven operating machine via control circuit 6. At the same time, in response to the identification signals transmitted from sensors 16 of detector 9, memory 38 reads out to position indicator 39 a code indicating the identity of the station at which the operating machine is located.

In a step 125, executed by computer 63 upon the reception thereby of an identification verification signal from position evaluation module 40, computer 63 generates and stores a status code identifying the station at which the coke oven operating machine is stopped. The computer checks the status of each operating machine in a step 126. If all the operating machines have reached their intended positions, as determined by the computer art a decision junction 127, computer 63 generates signals for controlling the commencement of filling and discharging operations. Upon the completion of the filling and discharging process, logic module 37 receives from computer 63 an enabling and renewed direction input signal. As soon as one of the positioning light gates is free, position evaluation module 40 transmits a "post-position pulse" to process computer 63 via lead 48. At the same time automatic read-monitoring module 41 is released and begins checking the identification transmitters 15 and sensors 16 continuously for errors in the event that both positioning light gates (11, 13 and 12, 14) are not covered. Upon the occurrence of an error, position evaluation module 40 and memory 38 are reset and the error is reported to computer 63. The computer then decides whether shifting of the coke oven operating machine along its track is to be continued or temporarily arrested.

The identifying and positioning functions performed by detector 9 and module 4 in conjunction with computer 63, as described above with reference to FIG. 4, is repeated upon the reaching of another positioning marker by one of the positioning light gates of detector 9.

The adjustable attachment of at least one of the positioning marker elements to support body 17 of signal plate 10 advantageously allows the setting of the response sensitivity and the adjustment of the tolerance of the position markers to the desired value and also enables selection of the hysteresis to optimize the deviation of the desired position as a function of the travel direction, i.e., to select the most advantageous value as a function of the different parameters of the coke oven operating machine.

Although the invention has been described in terms of specific embodiments and applications, one of ordinary skill in the art, in light of this teaching, can generate additional embodiments and modifications without departing from the spirit or exceeding the scope of the claimed invention. Accordingly, it is to be understood that the drawings and descriptions in this disclosure are proferred to facilitate comprehension of the invention and should not be construed to limit the scope thereof.

What is claimed is:

1. In combination with a coke oven in a coking plant, said coke oven being provided with at least one operating machine shiftably mounted on a track alongside said coke oven, an assembly for controlling the positioning of said operating machine along said track, comprising:

at least one signal plate;

detector means, including a plurality of signal transmitters in the form of infrared light sources and a like plurality of associated signal receivers in the form of infrared light sensors, for cooperating with said signal plate to generate positioning signals indicating the arrival of the shiftable operating machine at an operating station along said track and identification signals indicating the location of said operating station with respect to the coke oven, said detector means further including a U-shaped carrier having a pair of opposed legs accommodating said transmitters and receivers, one of said carrier and said signal plate being mounted to said operating machine and the other of said carrier and said signal plate being stationary with respect to said coke oven so that said legs of said carrier are disposed on opposite sides of said signal plate upon the arrival of said operating machine at said operating station;

drive means operatively coupled to said operating machine for shifting same along said track; and control means including an electronic evaluation circuit operatively connected to said detector means and to said drive means for controlling the motion and positioning of said operating machine along said track in response to said positioning signals and said identification signals so that, during a shifting of said operating machine, the velocity of said operating machine is reduced upon the transmission of a first positioning signal from said detector means to said control means, so that said operating machine is stopped upon the transmission of a second positioning signal and of an identification signal coding a preselected location alongside said coke oven, and so that the speed of said operating machine is increased upon the transmission of the second positioning signal and an identification signal coding an unselected location alongside said coke oven.

2. The combination as defined in claim 1 wherein said signal plate includes a support body and at least two positioning marker elements and a plurality of identification marker elements all mounted to said support body, said positioning marker elements being spaced from one another along a first line substantially parallel to said track, said identification marker elements being aligned along a second line spaced from and substantially parallel to said first line, said marker elements being opaque to a wavelength of infrared light generated by said transmitters and detected by said receivers, said transmitters forming a multiplicity of light gates with respective ones of said receivers, two of said light gates being disposed in a first plane containing said first line and a plurality of said light gates being disposed in a second plane containing said second line and oriented parallel to said first plane, said first positioning signal being generated in response to an interruption of an infrared light beam of one light gate in said first plane by one of said positioning marker elements, said second positioning signal being generated in response to an interruption of an infrared beam of another light gate in said first plane by said positioning marker elements, said identification signal being generated by light gates in said second plane upon generation of said second positioning signal and in accordance with interruptions of infrared beams of light gates in said second plane by said identification marker elements.

3. The combination as defined in claim 2 wherein said electronic evaluation circuit includes decoding means including a read memory operatively connected to said detector means for generating in response to said identification signal an electrical code signal identifying the location of an operating station occupied by said operating machine upon generation of said identification signal.

4. The combination as defined in claim 3 wherein said decoding means further includes an electronic read-monitoring circuit for cooperating with said read memory for detecting and correlating coded identification marker elements on said signal plate and light gates of said detector means.

5. The combination as defined in claim 4 wherein said electronic evaluation circuit includes an electronic position evaluation circuit operatively connected to said decoding means and to said drive means for controlling the speed and direction of motion of said operating machine along said track.

6. The combination defined in claim 2 wherein said signal plate is vertically oriented and said second line is located above said first line, said positioning marker elements being attached to said support body at opposite ends thereof, said identification marker elements being attached to said support body along an upper edge thereof so that said identification marker elements extend beyond said upper edge.

7. The combination as defined in claim 6 wherein at least one of said positioning marker elements is adjustably attached to said support body whereby the spacing of said positioning marker elements from one another along said first line may be altered.

8. The combination as defined in claim 7 wherein said electronic read-monitoring circuit is operatively connected to said detector means for continuously monitoring electrical output signals of said light gates during travel of said operating machine along said track between adjacent operating stations.

9. In combination with a coke oven in a coking plant, said coke oven being provided with at least one operating machine shiftably mounted on a track alongside said coke oven, an assembly for controlling the positioning of said operating machine along said track, comprising:

at least one signal plate, said signal plate including a support body and at least two positioning marker elements and a plurality of identification marker elements all mounted to said support body, said positioning marker elements being spaced from one another along a first line substantially parallel to said track, said identification marker elements being aligned along a second line spaced from and substantially parallel to said first line;

detector means, including a plurality of signal transmitters in the form of infrared light sources and a like plurality of associated signal receivers in the form of infrared light sensors, for cooperating with said signal plate to generate positioning signals indicating the arrival of the shiftable operating machine at an operating station along said track and identification signals indicating the location of said operating station with respect to the coke oven, said detector means further including a U-shaped carrier having a pair of opposed legs accommodating said transmitters and receivers, one of said carrier and said signal plate being mounted to said operating machine and the other of said carrier and said signal plate being stationary with respect to said coke oven so that said legs of said carrier are disposed on opposite sides of said signal plate upon the arrival of said operating machine at said operating station, said marker elements being opaque to a wavelength of infrared light generated by said transmitters and detected by said receivers, said transmitters forming a multiplicity of light gates with respective ones of said receivers, two of said light gates being disposed in a first plane containing said first line and a plurality of said light gates being disposed in a second plane containing said second line and oriented parallel to said first plane, said first positioning signal being generated in response to an interruption of an infrared light beam of one light gate in said first plane by one of said positioning marker elements, said second positioning signal being generated in response to an interruption of an infrared beam of another light gate in said first plane by said positioning marker elements, said identification signal being generated by light gates in said second plane upon generation of said second positioning signal and in accordance with interruptions of infrared beams of light gates in said second plane by said identification marker elements;

drive means operatively coupled to said operating machine for shifting same along said track; and control means including an electronic evaluation circuit operatively connected to said detector means and to said drive means for controlling the motion and positioning of said operating machine along said track in response to said positioning signals and said identification signals so that, during a shifting of said operating machine, the velocity of said operating machine is reduced upon the transmission of a first positioning signal from said detector means to said control means, so that said operating machine is stopped upon the transmission of a second positioning signal and of an identification signal coding a preselected location alongside said coke oven, and so that the speed of said operating machine is increased upon the transmission of the second positioning signal and an identification signal coding an unselected location alongside said coke oven, said electronic evaluation circuit including decoding means with a read memory operatively connected to said detector means and an electronic read-monitoring circuit for detecting and correlating coded identification marker elements on said signal plate and light gates of said detector means, said electronic evaluation circuit further including an electronic position evaluation circuit operatively connected to said decoding means and to said drive means for controlling the speed and direction of motion of said operating machine along said track.

10. The combination as defined in claim 9 wherein said signal plate is vertically oriented and said second line is located above said first line, said positioning marker elements being attached to said support body at opposite ends thereof, said identification marker elements being attached to said support body along an upper edge thereof so that said identification marker elements extend beyond said upper edge.

11. The combination as defined in claim 10 wherein at least one of said positioning marker elements is adjustably attached to said support body whereby the spacing of said positioning marker elements from one another along said first line may be altered.

12. The combination as defined in claim 11 wherein said electronic read-monitoring circuit is operatively connected to said detector means for continuously monitoring electrical output signals of said light gates during travel of said operating machine along said track between adjacent operating stations.

* * * * *